United States Patent [19]

Balaban

[11] 4,326,713

[45] Apr. 27, 1982

[54] RACKET STRINGING APPARATUS AND METHOD

[76] Inventor: John A. Balaban, 4142 Graham St., Pleasanton, Calif. 94566

[21] Appl. No.: 99,215

[22] Filed: Dec. 3, 1979

Related U.S. Application Data

[63] Continuation-in-part of Ser. No. 11,145, Feb. 12, 1979, Pat. No. 4,249,732.

[51] Int. Cl.[3] ..... A63B 51/16

[52] U.S. Cl. ..... 273/73 A

[58] Field of Search ..... 273/73 R, 73 A, 73 B, 273/73 C, 73 D, 73 E; 73/145; 140/123.5; 57/310; 242/147 R, 149, 150 R, 156, 156.2; 254/134.3 R

[56] References Cited

U.S. PATENT DOCUMENTS

| | | | |
|---|---|---|---|
| 1,863,059 | 6/1932 | Jaffe | 273/73 A |
| 2,033,264 | 3/1936 | Tope | 273/73 A |
| 2,091,654 | 8/1937 | Roberts et al. | 273/73 B |
| 2,154,870 | 4/1939 | Serrano | 273/73 A |
| 3,441,275 | 4/1969 | Held | 273/73 A |
| 3,823,609 | 7/1974 | Miyagawa et al. | 273/73 A X |
| 3,918,713 | 11/1975 | Kaminstein | 273/73 A |
| 3,994,495 | 11/1976 | Stoffel | 273/73 A |

FOREIGN PATENT DOCUMENTS

| | | | |
|---|---|---|---|
| 314595 | 7/1929 | United Kingdom | 273/73 A |
| 426485 | 4/1935 | United Kingdom | 273/73 B |
| 472300 | 9/1937 | United Kingdom | 273/73 E |

*Primary Examiner*—Richard J. Apley

*Attorney, Agent, or Firm*—Manfred M. Warren; Robert B. Chickering; Glen R. Grunewald

[57] ABSTRACT

A racket stringing machine having a racket head holding fixture and a carriage mounted for reciprocation toward and away from the fixture and a string clamp mounted on the carriage for engaging a string drawn through a racket head mounted on the fixture for tensioning the string upon movement of the carriage away from the fixture; a first brake which is automatically set upon drawing of the string to an elevated tension greater than the desired final predetermined tension to effect a pre-stretching of the string to a length beyond its length at such predetermined tension while permitting a decrease in the string tension; and a second brake which is automatically set to lock the string at the desired final predetermined tension. The apparatus also includes means for providing a controlled restrained rate of increase in string tension and a controlled restrained rate of decreasing string tension at tensions between the predetermined tension and maximum tension. Means is also provided for adjusting the amount of pre-stretching of the string.

16 Claims, 6 Drawing Figures

RACKET STRINGING APPARATUS AND METHOD

CROSS-REFERENCE TO RELATED APPLICATION

This application is a continuation-in-part of application Ser. No. 011,145, filed Feb. 12, 1979 and now U.S. Pat. No. 4,249,732.

BACKGROUND OF THE INVENTION

The invention relates to machines used for stringing of tennis rackets and the like and particularly to those machines which incorporate structure designed to assist in the obtaining of the desired objective of a uniform tensioning of the strings.

U.S. Pat. No. 3,441,275 discloses a machine in which the string is tensioned by manual rotation of a crank causing displacement of a carriage and string clamp away from a fixture holding the racket head and in which the carriage is automatically locked against displacement relative to the head when the string reaches a predetermined tension. U.S. Pat. No. 2,154,870 incorporates a friction clutch in the string tensioning structure so that only a predetermined degree of tension can be imparted to the string. Due, however, to the many factors involved such as varying friction between the engaged strings and racket head, subsequent stress relieving of the strings, and other factors, a variable, uncertain and random loss of string tension will result. Nor is the loss consistent, but will vary from string-to-string and between the longitudinal main strings and the cross strings. The amount of stress release cannot be precisely determined and will vary with size, quality and length of string used and the variable, random friction between contacting strings. Moreover, stress release will occur over a period of time so that the playing characteristics of a racket will change (deteriorate) with use. Accordingly, expert players have come to accept a required break-in period for a newly strung racket. However, even accepting a break-in period, the player cannot know in advance what the ultimate tension and playing characteristics of the racket will be. The above-noted inconsistency may vary anywhere from about ten to twenty pounds from string-to-string, even after the break-in period.

SUMMARY OF THE INVENTION

As pointed out in my copending application, Ser. No. 011,145, I have found that the above-noted disadvantages may be overcome by pre-stretching of the racket string to an elevated tension greater than the desired final predetermined tension to effect a pre-stretching of the string to a length beyond its length at such predetermined tension and then permitting the string to contract to its predetermined tension at which point it is locked in place in the racket head. Such pre-stretching minimizes the characteristics that allow the strings to settle or relieve stresses and lose tension with use in time. Use of my apparatus and method has virtually eliminated the need for a break-in period for newly strung rackets. The racket is ready for use as it comes off of the stringing machine. Moreover, the rate of string tension loss due to playing stress and time is substantially reduced thereby maintaining good string tension over a much longer period of time and use. Rackets strung in accordance with the present invention will have a significantly more uniform tension string-to-string, providing an improved overall evenness of resilience and improved accuracy of ball action and control. Moreover, the invention affords repeatability in enabling stringing of a racket to a much more precise string tension assuring the player in advance of what the string tension will be.

An object of the present invention is to provide a racket stringing apparatus and method of the character described which will afford precise control over the amount of string pre-stretching so that the pre-stretching of each string in the racket is automatically controlled.

Another object of the present invention is to provide an apparatus and method as above described which will permit ready manual adjustment of the amount of pre-stretching of the racket strings thus enabling customizing of string tension for different types of strings, racket heads, etc.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

DETAILED DESCRIPTION OF THE INVENTION

Figures 1, 4, 5, 6:
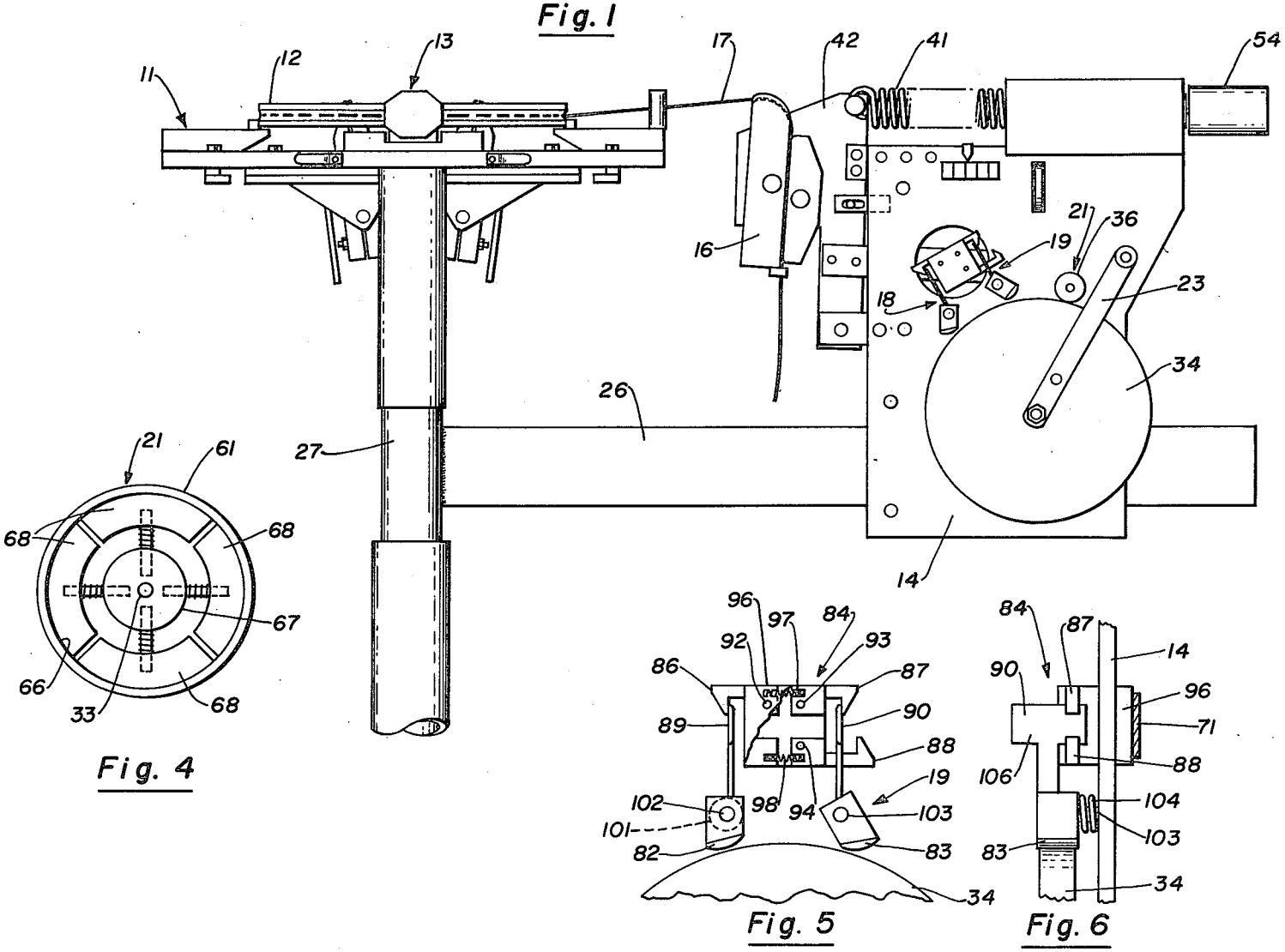
FIG. 1 is a side elevation of a racket stringing apparatus constructed in accordance with the present invention.
FIG. 4 is a front elevation of a part of the apparatus.
FIG. 5 is a front elevation of a part of the apparatus with portions removed.
FIG. 6 is a fragmentary end elevation of the structure illustrated in FIG. 5.

The racket stringing apparatus of the present invention comprises, briefly, a fixture 11 for holding the head 12 of a racket such as the conventional tennis racket 13; a carriage 14 mounted for reciprocation toward and away from fixture 11, and a string clamp 16 mounted on the carriage for engaging a string 17 drawn through the racket head 12 and across the open interior thereof for tensioning of the string upon movement of the carriage away from the fixture; means 18 functioning automatically in response to string tension to limit carriage movement away from the fixture at a position of maximum predetermined string tension; and means 19 functioning automatically on return movement of the carriage from such position and in response to decreasing string tension to lock the carriage against further return movement at a second position corresponding with a second predetermined less than maximum string tension. Accordingly, pursuant to the method of the present invention, string 17 is drawn across the interior opening of the racket head to an elevated tension greater than the desired final predetermined tension so as to effect a pre-stretching of the string to a length beyond its length at such predetermined tension, wherein the maximum tension and amount of pre-stretching is automatically limited, and then the string tension is decreased to permit contraction of the string with the latter being automatically locked at the desired predetermined tension.

In many instances, it is desirable in the interest of obtaining uniformity of results that the rate of increase of string tension as the string approaches maximum tension be restrained and similarly that the rate of decreasing string tension through the return movement to final tension be likewise restrained. It is desired that the final tensioning and pre-stretching of the string be done slowly and at a uniform rate rather than leaving the speed at which such tensioning and pre-stretching is accomplished to the random operation of the person using the apparatus. Similarly, a slow and uniformly controlled movement is desired as the maximum string tension is relaxed to the final predetermined tension. It has been found that very good results have been obtained by controlling this rate of tensioning and relaxation over the last approximately 2 to 5 pounds of string pull. Within this range the carriage to fixture movement is preferably held to a substantially uniform speed of not exceeding about 0.4 inches per second.

The above-described controlled tensioning may be accomplished by a variety of mechanisms. As here shown, a governor 21 is interposed in the drive mechanism over the critical portions of the drive range as noted. The drive in the present apparatus comprises a drive pinion 22 mounted on carriage 14 for rotation by a manually engaged crank arm 23 and enmeshed with a rack 24 mounted on an arm 26 extending laterally from a standard 27 supporting the racket head holding fixture 11. Carriage 14 is provided with rollers 28 which are keyed for longitudinal reciprocation on guide edges 31 and 32 on arm 26, see FIG. 3. Pinion 22 is fixed to a shaft 33 connecting the pinion to crank arm 23, and there is also fixed to the shaft for conjoint rotation therewith, a brake wheel 34. Governor 21 has a driven wheel 36, see FIGS. 1 and 2, which is moved into and out of engagement with the periphery of wheel 34 to apply, or not apply, the above-described restraining force.

In the present apparatus, string clamp 16 is mounted for relative movement on carriage 14 against the resistance of a spring 41 so that the relative motion of the clamp and carriage will be directly proportional to the tension applied to string 17. This relative displacement of the parts is here used to effect the actuation of the several automatic functions of the machine hereinabove alluded to. String clamp 16 is here carried by a lever 42 which is here pivotally attached at its lower end 43 by bolt 44 and bracket 45 to carriage 14, and is attached at its upper end 47 to one end 48 of helical spring 41 which is connected at its opposite end 49 to a spring rest and follower part 51. The latter is threadably connected to a screw 52 threaded through a mounting block 53 on carriage 14 and terminated in a manually engageable knob or handle 54 at the exterior side of block 53. Normally, and with the parts at rest, spring 41 will rotate lever 42 into abutment with an adjacent side 56 of the carriage. Accordingly, handle 54 may be rotated to adjust the resilient resistance to expansion of spring 41 upon tensioning of string 17 and, accordingly, a relative displacement of lever 42 away from the carriage. An indicator arm 57 is here connected to follower part 51 and terminates in a pointer end 58, see FIG. 3, which moves along a scale 59 on the carriage thus enabling the operator to precisely set the tension of spring 41 in terms of the desired final predetermined tension to be placed on string 17.

As above noted, motion is taken off from lever 42 to control the above-described intermittent operation of governor 21. As here shown in FIGS. 3 and 4, the governor comprises a cylindrical housing 61 mounted eccentrically on an arm 62 pivoted at 63 to carriage 14. A shaft 64 is mounted axially of an internal cylindrical wall 66 of housing 61 and carries driven wheel 36. A hub 67 on shaft 33 supports for rotation with the shaft and for radial reciprocation within wall 66 a plurality of centrifugally displaced governor weights 68. Upon driving of governor wheel 21 by brake wheel 34, weights 38 will be centrifugally thrown into frictional engagement with the interior wall 66 to apply the above-described controlled restrain rate of increasing and decreasing string tension.

Figure 3:
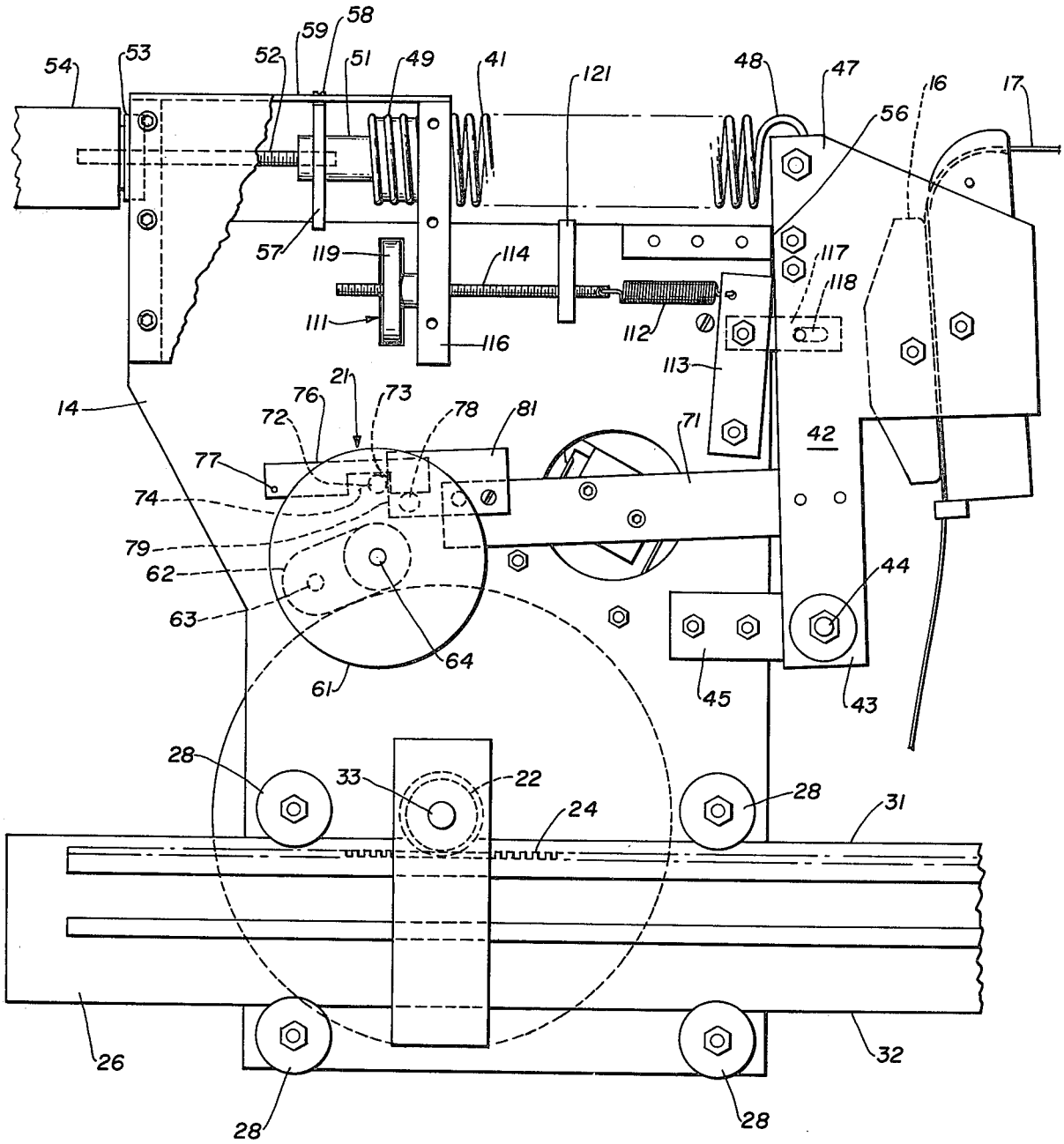
FIG. 3 is a side elevation of the apparatus with a portion removed, the view being taken from the opposite side of the machine from FIG. 2.

As above noted, the governor is placed in operation only as the parts are moved through their final reciprocating courses of movement. This is here accomplished by normally supporting governor 21 in a raised position, about pivot 63, so as to separate driven wheel 36 from brake wheel 34 during all of the operation except for the final pre-stretching and relaxing of the string. As here shown, governor housing 61 is released for engagement of driven wheel 36 with brake wheel 34 at the desired time in the operation by the displacement of an arm 71 fixed to and movable with lever 42. In the elevated inactive position of the governor, a roller 72 on the rear side of the governor housing 61 is supported against face 73 of recess 74 in a lever 76 pivoted at 77 to the carriage, thus preventing a downward clockwise rotation of the governor housing about its eccentric pivot 63. Upon tensioning of string 17, arm 71 will move in a clockwise direction as seen in FIG. 3, causing a roller 78 at the distal end of arm 71 to engage the underside of the free end of lever 76 causing the latter to elevate in a counterclockwise direction releasing roller 72 from face 73 at the desired time to permit the governor to rotate downwardly to engage its driven wheel 36 with brake wheel 34, this occurrence being arranged just before the final tensioning and pre-stretching of the string. In this operation, roller 72 remains in contact with an end face 79 of a bracket 81 at the distal end of arm 71 but end face 73 moves to the right, as seen in FIG. 3, during the tensioning of string 17 to permit clockwise rotation of the governor housing. Upon return movement of the string clamp lever 42 and arm 71, end face 79 will displace roller 72 to effect a counterclockwise raising of the governor housing, a dropping of the distal end of lever 76, and a re-entry of roller 72 into recess 74 and into its supported engagement against notch face 73.

Figure 2:
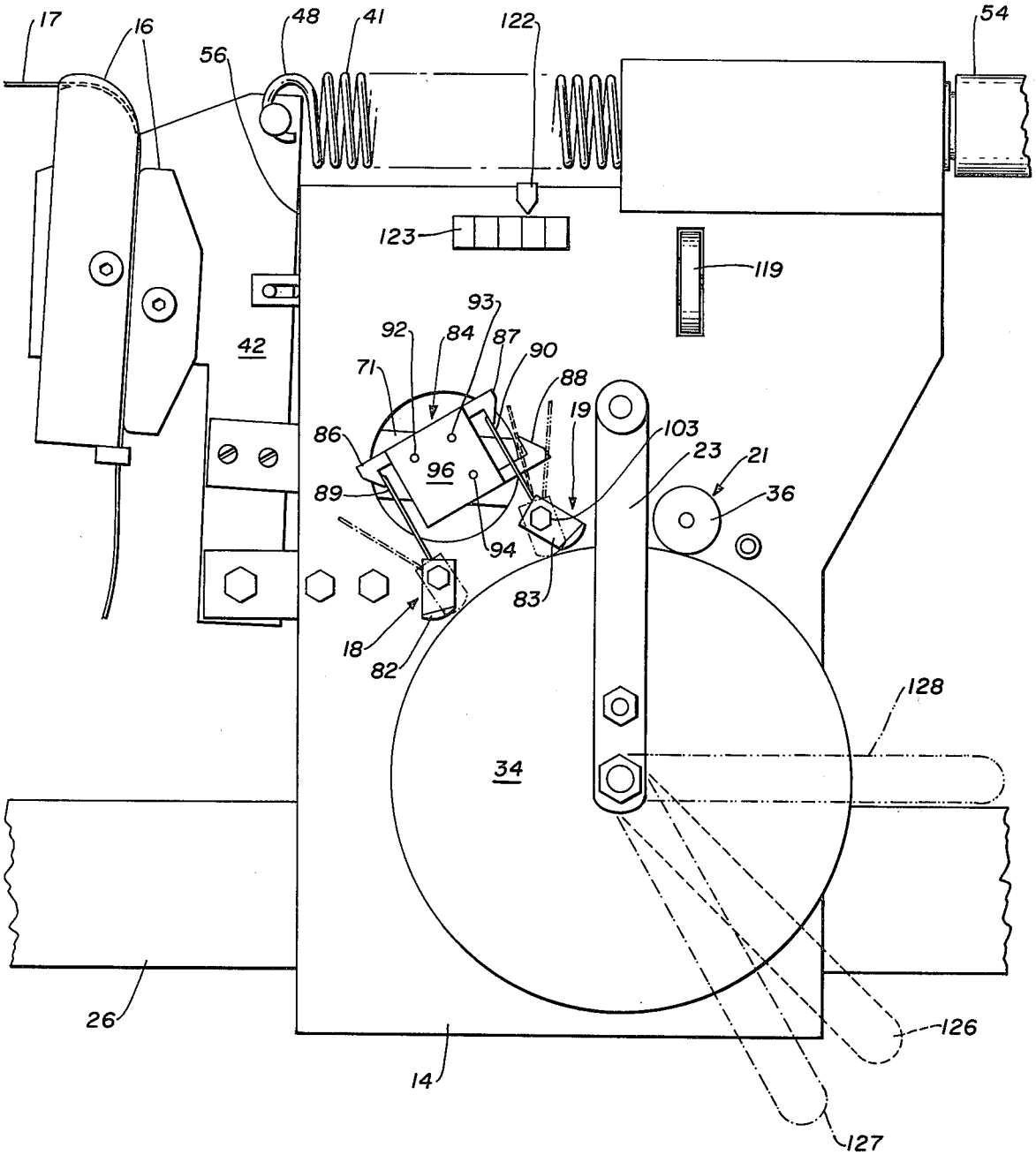
FIG. 2 is a fragmentary side elevation on an enlarged scale of a portion of the apparatus.

The means for automatically limiting carriage movement away from the fixture at position of maximum predetermined string tension and the means functioning automatically on return movement of the carriage to lock carriage movement at the final predetermined string tension, here comprises a brake shoe 82 mounted for movement into engagement with brake wheel 34 to effect unidirectional locking of the brake wheel limiting carriage movement away from fixture 11; and a second brake shoe 83 mounted for movement into engagement with brake wheel 34 to effect unidirectional locking thereof limiting return movement of carriage 14. In accordance with the present structure, brake shoes 82 and 83 are automatically set by structural means 84 cofunctioning with the relative displacement of string clamp arm 42. As here shown, latches 86, 87 and 88 are mounted on arm 71, see FIGS. 2 and 3, in position for engagement and disengagement with pawls 89 and 90 connected to brake shoes 82 and 83 for selectively releasing the latter for movement to locking position against brake wheel 34 as the latches are first rotated in a counterclockwise direction, as seen in FIG. 2, on increasing string tension, and then in a clockwise direction on decreasing string tension. As here shown, latches 86, 87 and 88 are pivotally secured about pins 92, 93 and 94 to a mounting block 96, in turn, secured to arm 71, the latches being normally biased to position shown in FIG. 5 by springs 97 and 98. In the course of tensioning of string 17, lever 42 will move to the left, as seen in FIG. 2, causing the latch mounting block to rotate counterclockwise. As the string is tensioned to about its desired final predetermined tension, latch 87 will release pawl 90 and the latter will rotate clockwise as seen in FIG. 2, until pawl 90 is engaged by latch 88 to hold shoe 83 still out of engagement with brake wheel 34, thus permitting further advance of the carriage to effect the important pre-stretching of string 17. As carriage advance continues by rotation of crank handle 23, arm 71 and the latch assembly will continue to rise. At the end of the pre-stretching operation, latch 86 will release pawl 89 to permit brake shoe 82 to rotate into locking position against brake wheel 34 under the action of biasing spring 101 mounted around shaft 102 pivoting brake shoe 82. With brake shoe 82 set in this manner, brake wheel 34 is locked against further advance of the carriage, but due to the eccentric mounting of brake shoe 82 on shaft 102, brake shoe 82 locks wheel 34 only in the direction of advance of string tension, while permitting return movement of the brake wheel. Brake shoe 83 is similarly mounted about shaft 103 and is biased to locking position against brake wheel 34 by spring 104 coiled around shaft 103 and having its end connected in the same manner as spring 101 to the carriage and brake shoe. As will be best seen in FIG. 6, pawl 90 is formed with a wing-shaped top 106 which when released from latch 87 will move under the action of spring 104 into caught engagement with latch 88 and the latter is positioned to retain brake shoe 83 out of locking engagement with brake wheel 34. During the return movement of the carriage following point of maximum tension on string 17, the latch mounting block will lower and at the desired predetermined final string tension, latch 88 will release pawl 90 to lock brake wheel 34 against further return movement. The string is then secured in the racket head, released from string clamp 16, and re-threaded through the next string openings in the racket head for tensioning of the next string pass. Prior to re-setting the string in string clamp 16, pawls 89 and 90 are manually engaged and swung into engagement with latches 86 and 87 thus freeing brake wheel 34 for tensioning of the next string pass. In this operation, it will be observed that as the string is tensioned, pawl 90 will first be released by latch 87 but caught by latch 88 for later release. At the end of the pre-stretching operation, brake shoe 82 is set to automatically lock the brake wheel 34 against further advance, thus precisely setting the amount of pre-stretching of the string. During the return movement of the carriage, brake shoe 83 will be set at the precise desired final tensioning of string 17. Thus a desired uniformity is obtained not only in the precise final tension left in the string but also in the precise pre-stretching of the string over and above the final string tension.

As a further feature of the present invention means 111 is provided for permitting the operator to precisely adjust the amount of pre-stretching of string 17 preceding the establishing of its final predetermined tension. This is here accomplished by adjusting the tensions on string 17 corresponding to the positions of release of latches 86–88, and more specifically, by the introduction of a second spring 112 mounted between carriage 14 and lever 42, see FIG. 3, and functioning to augment the action of spring 41 in resisting the separation between the carriage and lever 42 upon tensioning of string 17. Spring 112 here has one end connected to a lever 113 carried by carriage 14 and one end of a screw 114 mounted through a mounting member 116 secured to carriage 14. Lever 113 is connected to lever 42 by a link 117 having a loss motion connection 118 to lever 42. Accordingly, as lever 42 swings away from carriage 14 under the resistance of spring 41, it will after a short movement pick up the action of spring 112 which adds its resilience to spring 41. A manually engageable knob 119 is secured to screw 114 and bears against one side of member 116 to cause tensioning of spring 112 as lever 113 moves with lever 42 away from carriage 14. An indicator arm 121 is carried on screw 114 and has a pointer end 122, see FIG. 2, which moves along a scale 123 mounted on carriage 14 to indicate the precise amount of pre-stretching of the string. In the case of tennis rackets, a pre-stretching of the string of about 10 to 15 pounds has been found to be best, although in some instances this may be increased up to about 25 pounds, depending upon type of string, final desired string tension, etc. The present structure ensures that the amount of pre-stretching when determined will be a consistent repeatable process for each string pass through the racket head. Moreover, it will be noted that the tension on string 17 after pre-stretching and on return to final tension finds an automatic balance with the elongating tension on spring 41 so that any delay in securing the string will not result in continued elongation of the string. This automatic balancing action is in contrast, for example, to the tensioning of the string with a fixed weight or constant force. In the present structure string elongation results in spring contraction and a reduction in spring tension thus producing an equilibrium stabilizing string elongation.

The operation of the present machine, as seen in the rotation of crank handle 23, is depicted in FIG. 2. Assuming that at the start of tensioning of string 17 handle 23 will be in a generally upright position, as shown in full lines in the FIGURE. The handle is then rotated in a clockwise direction to position indicated at 126 at which point latch 87 will release pawl 90 for movement into engagement with latch 88. Further clockwise rotation of handle 23 to position 127 will cause further tensioning and pre-stretching of string 17 and at about position 127, latch 86 will release pawl 89 for setting of brake 82 thereby stopping further forward movement of the handle. The operator then starts the return, counterclockwise, movement of handle 23 and as the final predetermined tension of string 17 is reached and at about position 128 of the handle, latch 88 will release pawl 90 to lock brake wheel 34 against further return. The string at its final predetermined tension may then be secured in the racket head in the usual fashion.

What is claimed is:

1. In a racket stringing apparatus having a racket head holding fixture and a carriage mounted for reciprocation toward and away from said fixture and a string clamp mounted on said carriage for engaging a string drawn through a racket head mounted on said fixture for tensioning said string upon movement of said carriage away from said fixture;

means for establishing a maximum predetermined string tension; said maximum predetermined string tension being such as to effect a pre-stretching of the string;

means for establishing a final predetermined string tension; said final predetermined string tension being significantly less than said maximum predetermined string tension so as to cause contraction of the string to a length significantly less than the length affected by said pre-stretching.

means functioning automatically in response to string tension to limit carriage movement away from said fixture and lock said carriage at the position of said maximum predetermined string tension; and means functioning automatically on return movement of said carriage from said position and in response to decreasing string tension to lock said carriage against further return movement and at a second position corresponding with said final predetermined string tension.

2. The apparatus of claim 1, and means functioning during movement of said carriage away from said fixture and adjacent said first-named position to provide a controlled restrained rate of increase of string tension, and functioning to provide a controlled restrained rate of decreasing string tension throughout said return movement of said carriage.

3. The apparatus of claim 2, said last named means providing said controlled rate of increasing tensioning over the last two to five pounds of string pull.

4. The apparatus of claim 3, said controlled rate of increasing and decreasing string tension being effected by a relative carriage-to-fixture movement of not exceeding about 0.4 inches per second.

5. The apparatus of claim 1, wherein said relative carriage-to-fixture movement is effected by a manually rotatable crank;

a brake wheel connected for joint rotation with said crank;

said third-named means comprising a brake shoe mounted for movement into engagement with said wheel to effect unidirectional locking thereof limiting said carriage movement away from said fixture; and said fourth-named means comprising a second brake shoe mounted for movement into engagement with said wheel to effect unidirectional locking thereof limiting said further return movement of said carriage.

6. The apparatus of claim 5, wherein said string clamp is mounted for displacement relative to said carriage and means is provided for resisting such displacement as a function of string tension; and means connected to said carriage and string clamp and cofunctioning with said relative displacement thereof to automatically set said brake shoes against said wheel at said first-named and second positions.

7. The apparatus of claim 6, and manually operable means connected to said string clamp and carriage and cofunctioning with said relative displacement thereof for adjusting the amount of pre-stretching of said string preceding the establishing of said final string tension.

8. The apparatus of claim 7, said last-named means comprising:

a spring; and members connecting said spring to and between said clamp and carriage for providing resilient resistance to the separation thereof, one of said members being mounted for adjustment of the magnitude of said resilient resistance.

9. The apparatus of claim 8, said last-named member comprising a screw threadably mounted to provide on rotation said adjustment of said resilient tension;

a manually engageable knob connected to said screw for rotation thereof; and an indicator threaded on said screw and mounted for displacement upon rotation of said screw and to display the setting of said resilient tension.

10. The apparatus of claim 6, said fifth-named means comprising a helical spring connected to said clamp for elongation as a function of string tension.

11. The apparatus of claim 1, and means for adjusting the difference between said positions and correspondingly the amount of pre-stretching of said string preceding the establishing of said final string tension.

12. The apparatus of claim 1, wherein said string clamp is mounted for displacement relative to said carriage and means is provided for resisting such displacement as a function of string tension;

said third-named means comprising a unidirectional brake biased to an operable position locking carriage movement away from said fixture and permitting said return carriage movement;

said fourth-named means comprising a second brake biased to an operable position locking carriage movement toward said fixture; and latches connected for holding said brakes in inoperable position and functioning when released to permit setting of said brakes, said latches being connected to said string clamp and carriage and cofunctioning with said relative displacement thereof to automatically successively release said unidirectional and second-named brakes upon successive movement of said carriage to said first-named and second positions.

13. The apparatus of claim 12, and means for adjusting the correlation of string tension and the release points of said latches for adjusting the amount of pre-stretching of said string preceding the establishing of said final string tension.

14. The apparatus of claim 13, said last-named means comprising:

a spring; and members connecting said spring to and between said clamp and carriage for providing resilient resistance to the separation thereof, one of said members being mounted for adjustment of the magnitude of said resilient resistance.

15. A method of stringing a racket to a final permanent predetermined string tension comprising:

establishing a maximum predetermined string tension; said maximum predetermined string tension being significantly greater than said final predetermined string tension to effect a pre-stretching of said string to a length significantly beyond its length at said final predetermined string tension;

drawing said string across the racket head until said maximum predetermined string tension is reached;

automatically limiting said drawing at said maximum string tension and temporarily locking the string thereat;

decreasing the string tension to permit contraction of said string until said final determined string tension is reached;

and automatically locking said string at said final permanent predetermined string tension.

16. The method of claim 15, wherein said drawing and the tensioning of said string is effected by a helical spring connected thereto for elongation as a function of string tension thus stabilizing string elongation when locked at said final predetermined tension.

* * * * *